US007618285B2

(12) United States Patent
Xiang et al.

(10) Patent No.: US 7,618,285 B2
(45) Date of Patent: Nov. 17, 2009

(54) ELECTRICAL CONNECTOR ASSEMBLY

(75) Inventors: Xing-Hai Xiang, Kunshan (CN); Lun-Song Hu, Kunshan (CN); Zi-Qiang Zhu, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/316,094

(22) Filed: Dec. 8, 2008

(65) Prior Publication Data

US 2009/0149073 A1 Jun. 11, 2009

(30) Foreign Application Priority Data

Dec. 6, 2007 (CN) ..... 2007 2 0131265 U

(51) Int. Cl.
*H01R 13/60* (2006.01)

(52) U.S. Cl. ..... 439/541.5; 439/638; 439/607.25

(58) Field of Classification Search ..... 439/541.5, 439/607.21, 607.24, 607.25, 607.27, 607.28, 439/638

See application file for complete search history.

(56) References Cited

U.S. PATENT DOCUMENTS 5,037,330 A * 8/1991 Fulponi et al. ..... 439/607.23
5,085,590 A 2/1992 Galloway
5,601,438 A * 2/1997 Ho et al. ..... 439/64
5,823,822 A * 10/1998 Tan et al. ..... 439/541.5
5,851,125 A 12/1998 Hsu
5,989,041 A * 11/1999 Lin ..... 439/79
6,027,370 A 2/2000 Hsu
6,068,509 A * 5/2000 Lin ..... 439/541.5
6,077,114 A * 6/2000 Lu ..... 439/541.5
6,095,853 A * 8/2000 Huang et al. ..... 439/541.5
6,626,700 B2 * 9/2003 Lin ..... 439/541.5
7,044,778 B2 * 5/2006 Tanaka ..... 439/541.5
2003/0008552 A1 * 1/2003 Lin ..... 439/541.5
2009/0149072 A1 * 6/2009 Xiang et al. ..... 439/638
2009/0149073 A1 * 6/2009 Xiang et al. ..... 439/638

* cited by examiner

*Primary Examiner*—James Harvey
(74) *Attorney, Agent, or Firm*—Wei Te Chung; Andrew C. Cheng; Ming Chieh Chang

(57) ABSTRACT

An electrical connector assembly (100) includes a bracket (1) comprising a partition bar (10) and a pair of lower stands (12) extending downwardly from two opposite sides of the partition bar (10), a first electrical connector (2) located on the partition bar (10). The first electrical connector (2) includes a housing (20) defining a plurality of passages (207), a plurality of terminals (21) inserted into the passages (207), and a shell (22) covering the housing (20). The housing (20) is positioned above the partition bar (10). The bracket (10) further includes a lower receiving space (120) disposed under the partition bar (10) and the lower stands (12) there between. The passages (207) include a plurality of first passages (2071) arranged in three rows and a second passage (2072) different from the first passages (2071). The first passages (2071) and the second passage (2072) formed on opposite sides of the first housing (20).

17 Claims, 8 Drawing Sheets

ELECTRICAL CONNECTOR ASSEMBLY

BACKGROUND OF THE INVENTION

1. Field of the Invention

The present invention generally relates to an electrical connector assembly, and particularly relates to an electrical connector assembly having an electrical connector which is raised and for transmitting high frequency signal.

2. Description of Related Art

An electrical connector assembly generally includes a bracket and a D-Sub electrical connector retained on the bracket. The electrical connector defines a D-shape receiving space for receiving a plug in order to transmit low frequency analog signal. The electrical connector includes an insulative housing, a plurality of terminals received into the insulative housing and a metal shell enclosing a front end of the insulative housing. The insulative housing includes a base portion and a mating portion protruding forwardly from the base portion. The insulative housing defines a number of rows of terminal passages extending through the base portion and the mating portion for receiving the terminals. The terminal passages are formed of circularity shape and disposed on the mating portion. The terminals include a fixing portion secured with the insulative housing, a contact portion extending from the fixing portion into the passage of the mating portion and a soldering tail extending out of the bracket to connect to a PCB. The contact portion is formed in an offset manner in both vertical direction and left-to-right direction. A plug would be clamped by the contact portion while the plug inserted into the terminal passages.

Another electrical connector assembly of prior art includes a bracket, a D-Sub electrical connector and a DVI (Digital Visual Interface) electrical connector both retained on the bracket. The DVI electrical connector is positioned under the D-Sub electrical connector, and can not meet some specific requirements of users.

Each of the two D-Sub electrical connector is raised by the bracket refer wherein the two prior arts. The D-Sub electrical connector is applied widely than the DVI electrical connector before. If the bracket designed raised for the DVI electrical connector, It's structure would be designed difficulty and requires high manufacture technology because the number of the terminals of the DVI electrical connector is too many.

Hence, it is desirable to have an improved electrical connector assembly to overcome the above-mentioned disadvantages of the related art.

SUMMARY OF THE INVENTION

According to one aspect of the present invention, an electrical connector assembly comprising: a bracket including a partition bar and a pair of lower stands extending downwardly from two opposite sides of the partition bar; a first electrical connector located on the bracket, the first electrical connector includes a first housing defining a plurality of passages, a plurality of terminals secured into the first housing and a shell covering the first housing, the first housing positioned above the partition bar; wherein the bracket further including a lower receiving space disposed under the partition bar and the lower stands therebetween, the passages include a plurality of first passages arranged in a number of rows and a second passage different from the first passages; wherein the first passages and the second passage formed on opposite sides of the first housing.

The foregoing has outlined rather broadly the features and technical advantages of the present invention in order that the detailed description of the invention that follows may be better understood. Additional features and advantages of the invention will be described hereinafter which form the subject of the claims of the invention.

DETAILED DESCRIPTION OF THE PREFERRED EMBODIMENT

Figure 1:
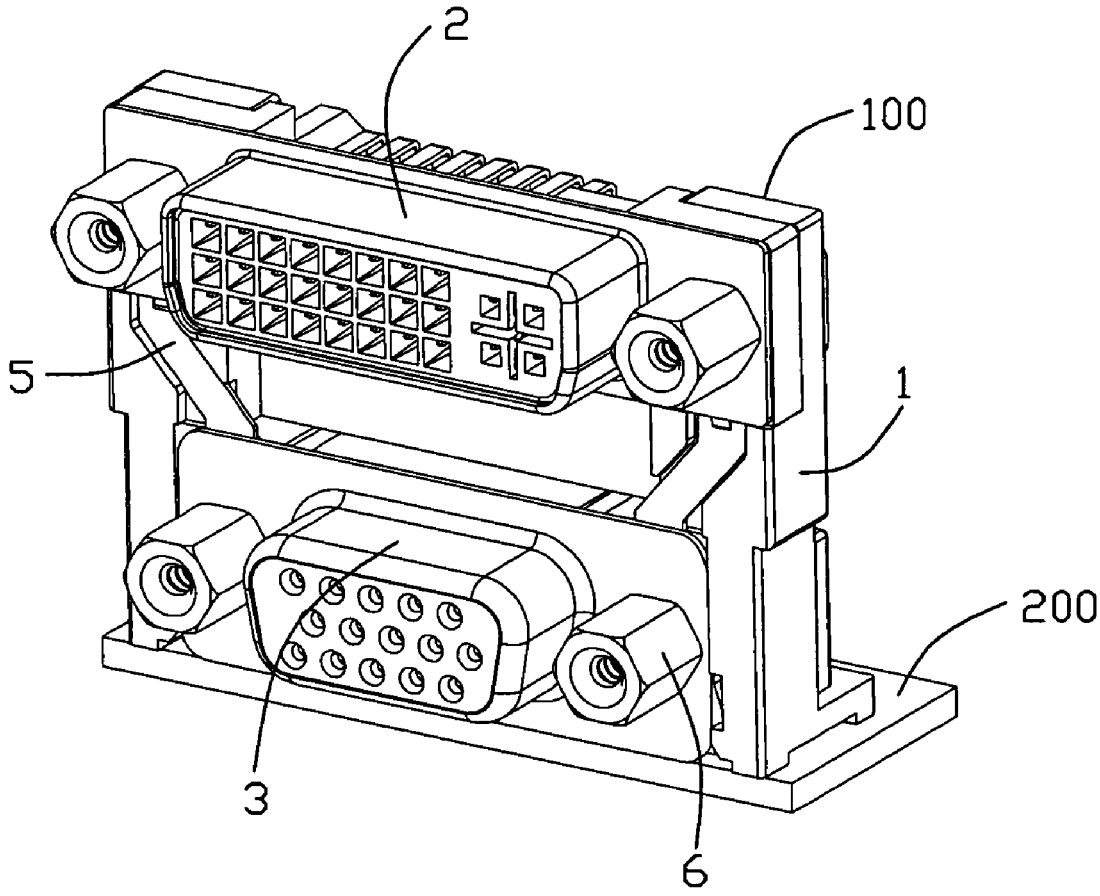
FIG. 1 is a front perspective view of an electrical connector assembly according to a preferred embodiment of the present invention in mounted on a PCB.
Figure 2:
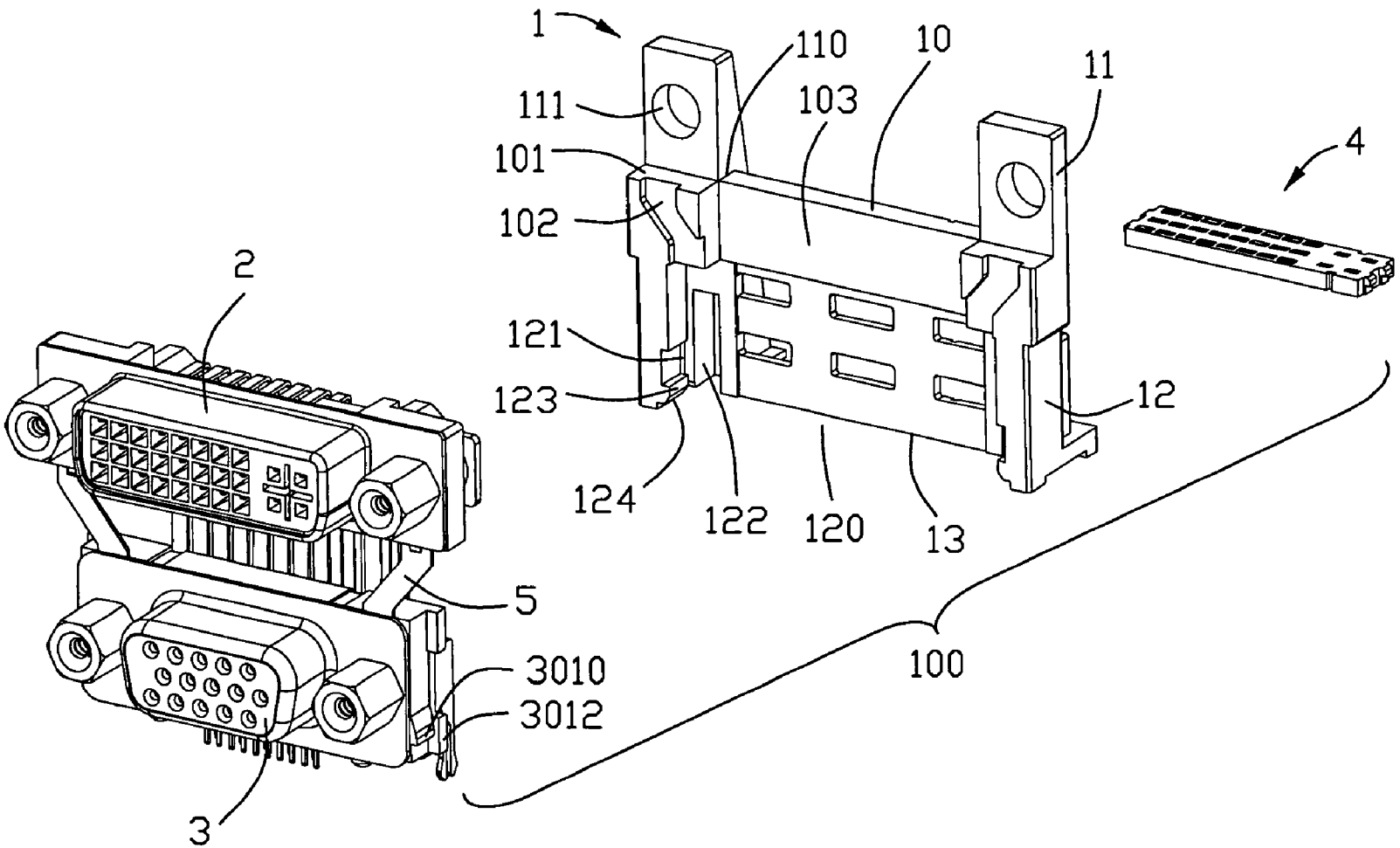
FIG. 2 is a partly exploded perspective view of the electrical connector assembly of FIG. 1.

Reference will now be made to the drawing figures to describe the present invention in detail.

With reference to FIGS. 1-8, an electrical connector assembly 100 in accordance with the present invention is mounted on a PCB 200 for connecting a mating plug (not shown) includes an a bracket 1, a first electrical connector 2 and a second connector 3 both retained on the bracket 1, a spacer 4 fixed on a bottom portion of the bracket 1, a metal connect plate 4 and two pairs of nuts 6 fixed on the first electrical connector 2 and the second electrical connector 3.

The bracket 1 formed by insulative materials, includes a lever partition bar 10, a pair of upper stands 11 extending upwardly from two opposite sides of the partition bar 10 and a pair of lower stands 12 extending downwardly from two opposite sides of the partition bar 10. The partition bar 10 defines a support surface 101 positioned at front of the upper stands 11. The partition bar 10 has two depression 102 positioned at two opposite sides and a slot 103 positioned at middle part therein. An upper receiving space 110 is formed by the pair of the upper stands 11 and the partition bar 10 for receiving the first electrical connector 2. The upper stands 11 define a pair of retaining holes 111. The bracket 1 includes a connect wall 13 connecting the pair of the lower stands 12 therebetween. A lower receiving space 120 is enclosed by the partition bar 10, the pair of the lower stands 12 and the connect wall 13 for receiving the second electrical connector 3. The lower stands 12 define a first slots 121 positioned at both of inner sides thereof and communicating to the lower receiving space 120. The connect wall 13 defines two second slots 122 positioned at two opposite two sides thereof. All of the first slots 121 and the two second slots 122 extend downwardly through out of the bracket 1.

The lower stands 12 define a block 123 having a guide surface 124. The bracket 1 defines two fixing portions 14 positioned two opposite side ends thereof and a triangular reinforcement wall 15 connecting the partition bar 10, the upper stand 11, the lower stand 12, the connect wall 13 and the fixing portion 14. The fixing portion 14 is positioned on a bottom portion of the bracket 1. The reinforcement wall 15 is positioned on a rear end of the bracket 1. each of the fixing portion 14 has a first fixing slot 141 extending along a front-to-back direction and a plurality of second fixing slots 142 under the first fixing slot 141. The first fixing slot 141 extending backwardly out of the bracket 1 is deeper than the second fixing slots 142 extending downwardly out of the bracket 1.

Figure 4:
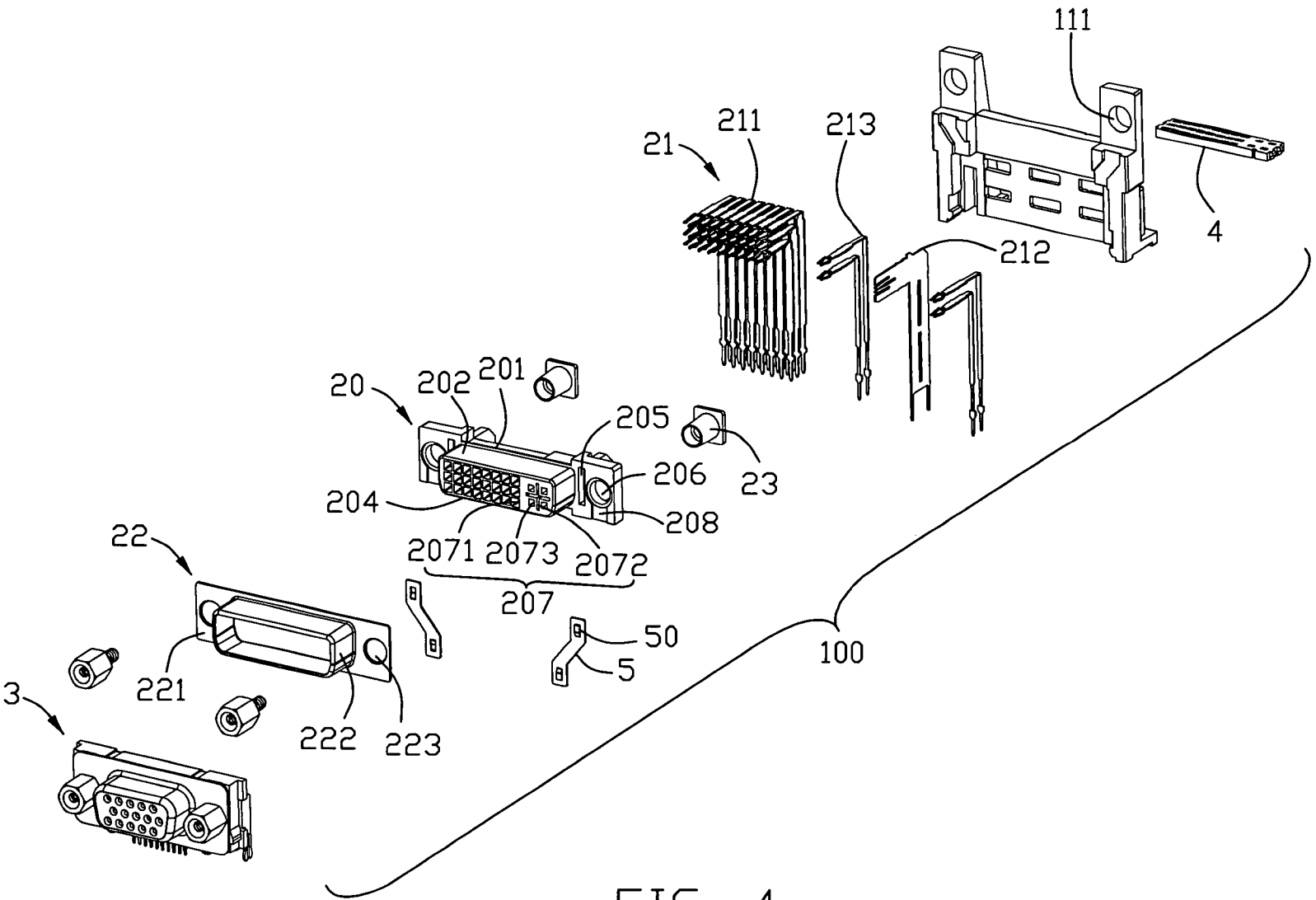
FIG. 4 is an exploded perspective view of the electrical connector assembly of FIG. 1.
Figure 5:
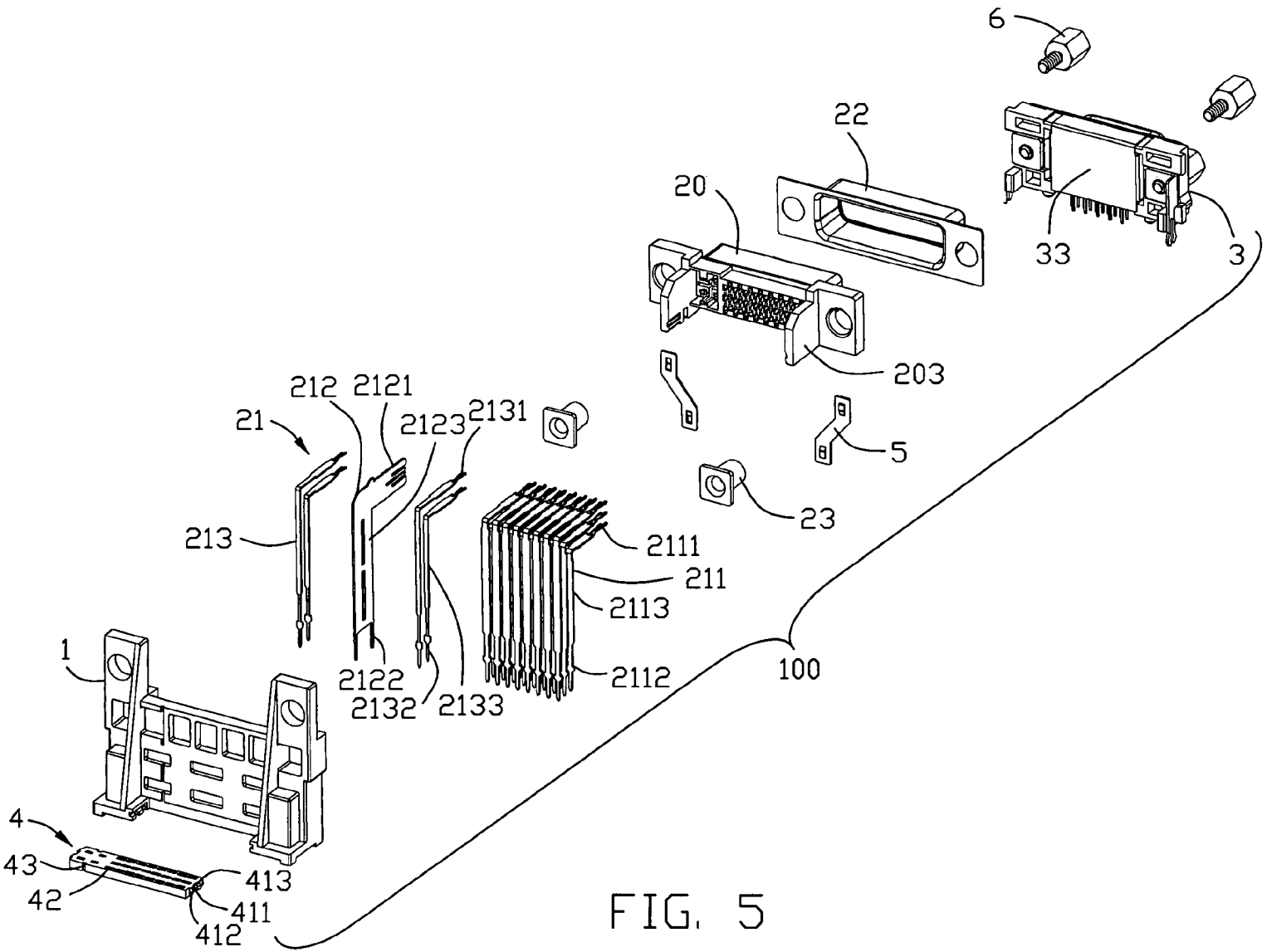
FIG. 5 is an another exploded perspective view of the electrical connector assembly of FIG. 1.

With reference to FIGS. 4-5, the first electrical connector 2 is a DVI electrical connector for transmitting high frequency digital signal corresponding to the preferred embodiment. The first electrical connector 2 includes a first housing 20, a plurality of terminals 21 received into the first housing 20, a metal first shell 22 covering the first housing 20 and a pair of rivets 23. The first housing 20 includes a base portion 201, a mating portion 202 protruding forwardly from the base portion 201, and a pair of side bars 203 parallel to each other. The mating portion 202 has a D-shape front mating surface 204. The base portion 201 defines a pair of engaging slots 205 adjacent to the mating portion 202 and a pair of through holes 206 corresponding to the retaining holes 111 of the bracket 1. The first housing 20 defines a depression 208 under the through hole 206 and a plurality of passages 207 extending through the base portion 201 and the mating portion 202. The passages 207 includes a plurality of first passages 2071 arranged in three rows, four third passages 2073 positioned at one side of the first passages 2071 and a second passage 2072 positioned at the third passages 2073 therebetween. The first passages 2071 are different from the second passage 2072 and the second passage 2072 are formed on opposite sides of the first housing 201. The second passage 2072 and the third passages 2073 are squarely positioned on the mating surface 204. The second passage 2072 are disposed in a cross type configuration on the mating surface 204. In the preferred embodiment, the number of the third passages 2073 is four.

The terminals 202 of the first electrical connector 2 include a plurality of first terminals 211 corresponding to the first passages 2071, a second terminal 212 corresponding to the second passage 2072 corresponding to the second passage 2072 and four third terminals 213 corresponding to the third passages 2073. The second terminal 212 is a grounding terminal. Each of the terminals 202 includes a contact portion 2111, 2121, 2131 inserted into the passages 207 for mating with the plug, a soldering tail 2112, 2122, 2132 and a connect portion 2113, 2123, 2133 connected between of the contact portion 2111, 2121, 2131 and the soldering tail 2112, 2122, 2132. Each of the contact portions 2111, 2131 of the first terminals 211 and the third terminals 213 is formed in an offset manner in both a vertical and a left-to-right direction. The soldering tails 2113, 2123, 2133 are bent downwardly from the contact portions 2111, 2121, 2131 for connecting to the PCB 200.

The first shell 22 includes a base bar 221 enclosing a front surface of the first housing 21 and a first frame 222 extending forwardly from the base bar 221. The base bar 221 also defines a pair of circular holes 223 corresponding to the through holes 206. The first frame 222 encloses the mating portion 202 of the first housing 20 except for the mating surface 202.

Figure 6:
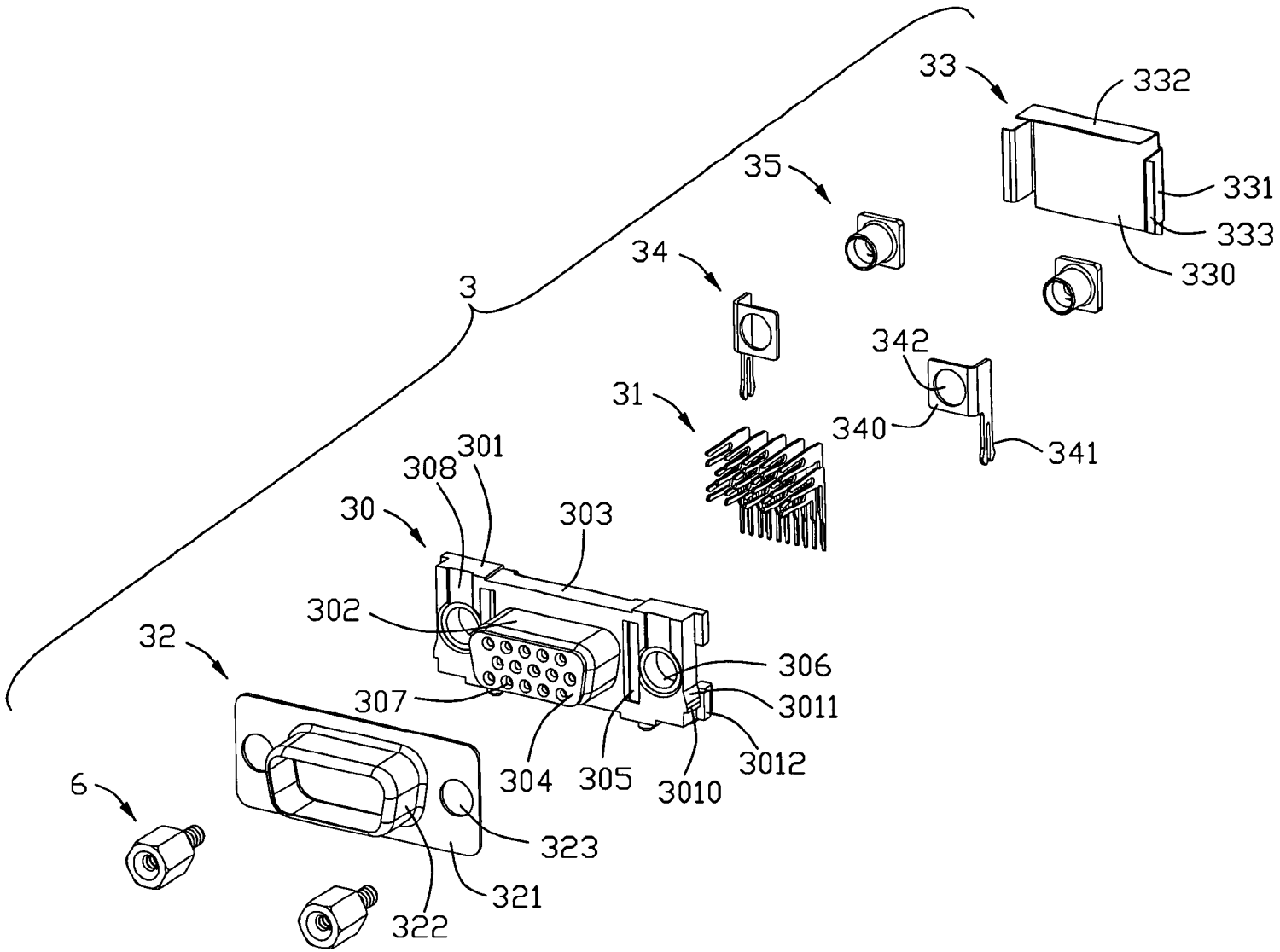
FIG. 6 is an exploded perspective view of a second electrical connector of the electrical connector assembly of FIG. 1.
Figure 7:
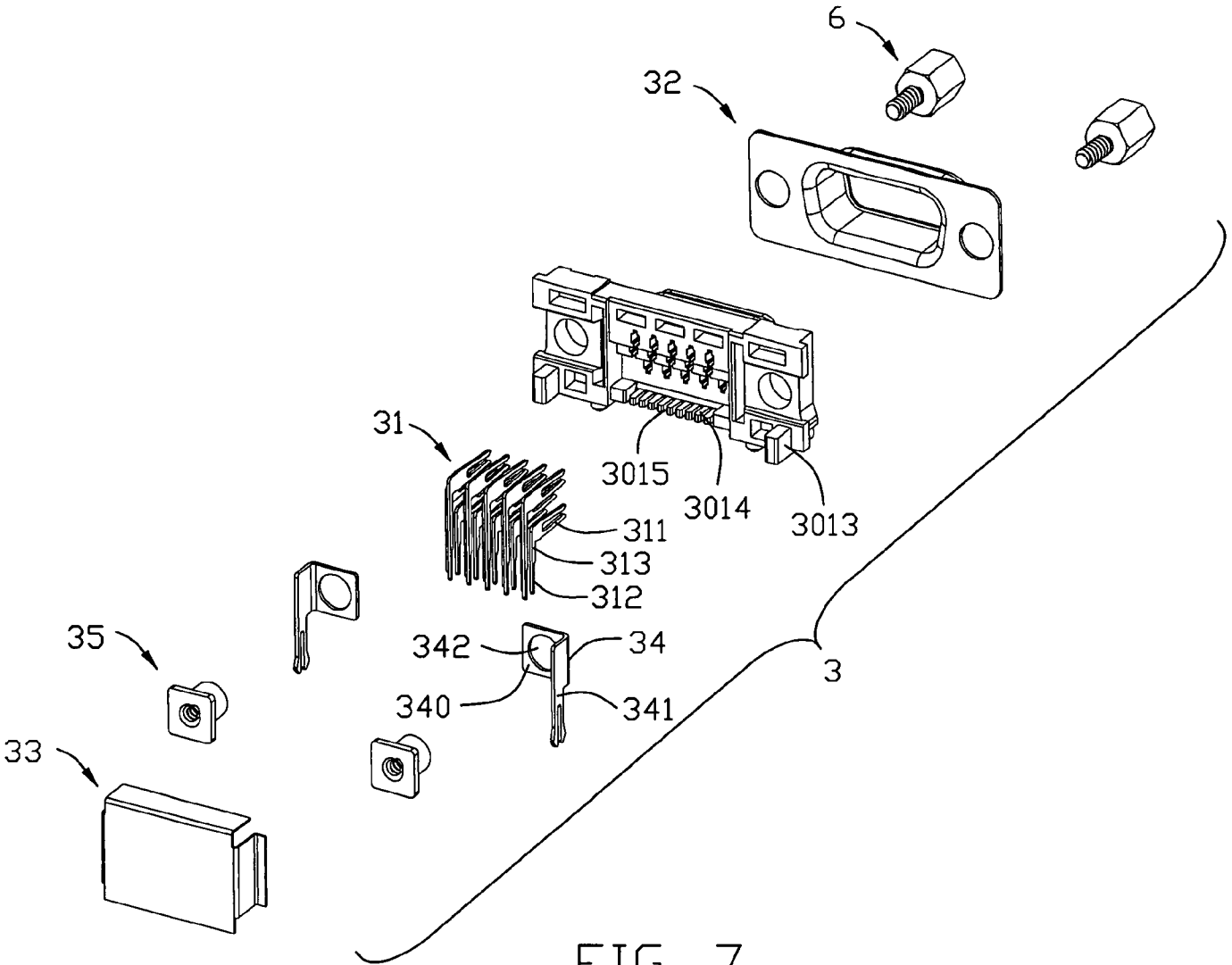
FIG. 7 is an another exploded perspective view of the second electrical connector of the electrical connector assembly of FIG. 1.
Figure 8:
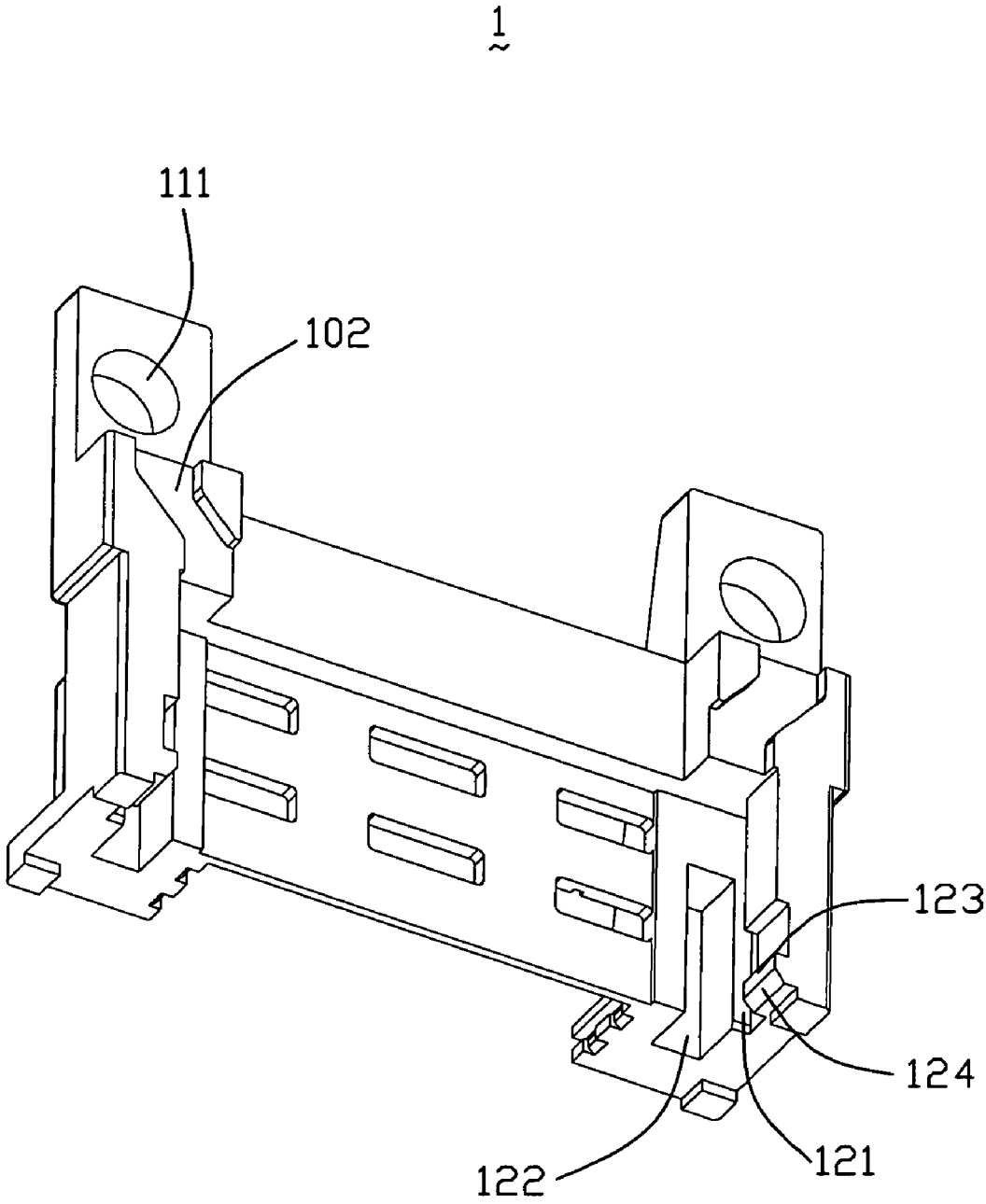
FIG. 8 is a rear view of a bracket of the electrical connector assembly of FIG. 1.

Referring to FIGS. 6-7, the second electrical connector 3 is D-Sub connector defined for transmitting low analog signal with a D-shape mating port. The second electrical connector 3 includes a second housing 30, a plurality of terminals 31 received into the second housing 30 and a second shell 32 covering the second housing 30, a metal shield 33 enclosing a rear end of the second housing 30, a pair of board locks 34 for mounting the second electrical connector 3 on the PCB 200 and a pair of rivets 35. The second housing 30 includes a base portion 301 and a mating portion 302 protruding forwardly from the base portion 301. The mating portion 302 defines a D-shape front mating surface 304. The base portion 301 defines a lengthwise recesses 303 positioned on a top end thereof, a pair of engaging slots 305 adjacent to two opposite sides of the mating portion 302 and pair of through holes 306 adjacent to the engaging slots 305. The base portion 302 defines a depression 308 extending upwardly from the through holes 306 and positioned on a front surface of the base portion 301.

The base portion 301 defines a pair of latch portions 3010 positioned two side ends with a guide surface 3011. The base portion 301 defines two pair of protrude bars 3012 closed to the lath portion 3010 and positioned on the upper and lower ends of the base portion 301. The base portion 301 has a pair of ribs 3013 extending backwardly from and extending from the protrude bars 3012. The second housing 30 defines a plurality of passages 307 extending through the base portion 301 and the mating portion 302. The passages 307 are circular in the mating surface 307. The base portion 301 has a pair of fixing bars 3014 extending backwardly and positioned on a bottom portion of the base portion 301. The fixing bar 3014 defines a plurality of fixing slots 3015 corresponding to the passages 307.

The terminals 31 of the second electrical connector 3 includes a contact portion 311, a soldering tail 312 extending downwardly out of the second housing 30 and a connect portion 313 connecting between of the contact portion 311 and the soldering tail 312. The contact portion 311 is formed in an offset manner in the vertical direction. The board locks 34 include a mounting portion 340 mounted with the PCB 200 and a mounting leg 341 extending backwardly and downwardly from the mounting portion 340. The mounting portion 340 defines a pinhole 342 corresponding to the through holes 306 of the second housing 30.

The second shell 32 includes a base bar 321 enclosing a front surface of the base portion 301 and a frame 322 enclosing the mating portion 302 except for the mating surface 304 of the second housing 30.

The shield 33 includes a rear wall 330, two side walls 331 bent from two opposite sides of the rear wall 330 and a top wall 332 bent from a top end of the rear wall 330. Each of the side walls 331 defines a fixing plate 333 bent inwardly therein.

While the second electrical connector 3 is in assembly, firstly, the terminals 31 are inserted into the corresponding the passages 307 from a rear end of the second housing 30. The contact portions 311 of the terminals 31 are disposed into the passages 307 of the mating portion 302 for contacting the plug. The connect portions 313 fixed with inner walls of the passages 207 of the second housing 30. The soldering tails 312 of the terminals 31 extend through out of the fixing bar 3014 and fixed by the fixing slots 3015 of the fixing bar 3014 in order to stop offsetting in a left-to-right direction.

Secondly, the shield 33 is covered the end of the second housing 30. The side walls 331 extends through the engaging slots 305 in order to urge the fixing plates 333 pressing on the front surface of the base portion 301. The top wall 332 is received into the recesses 333. Lastly, the second housing 30, the second shell 32 and the board locks 34 fixed each other by the rivets 35. The nuts 6 retained on a front end of the rivets 35 for fixing the plug.

Figure 3:
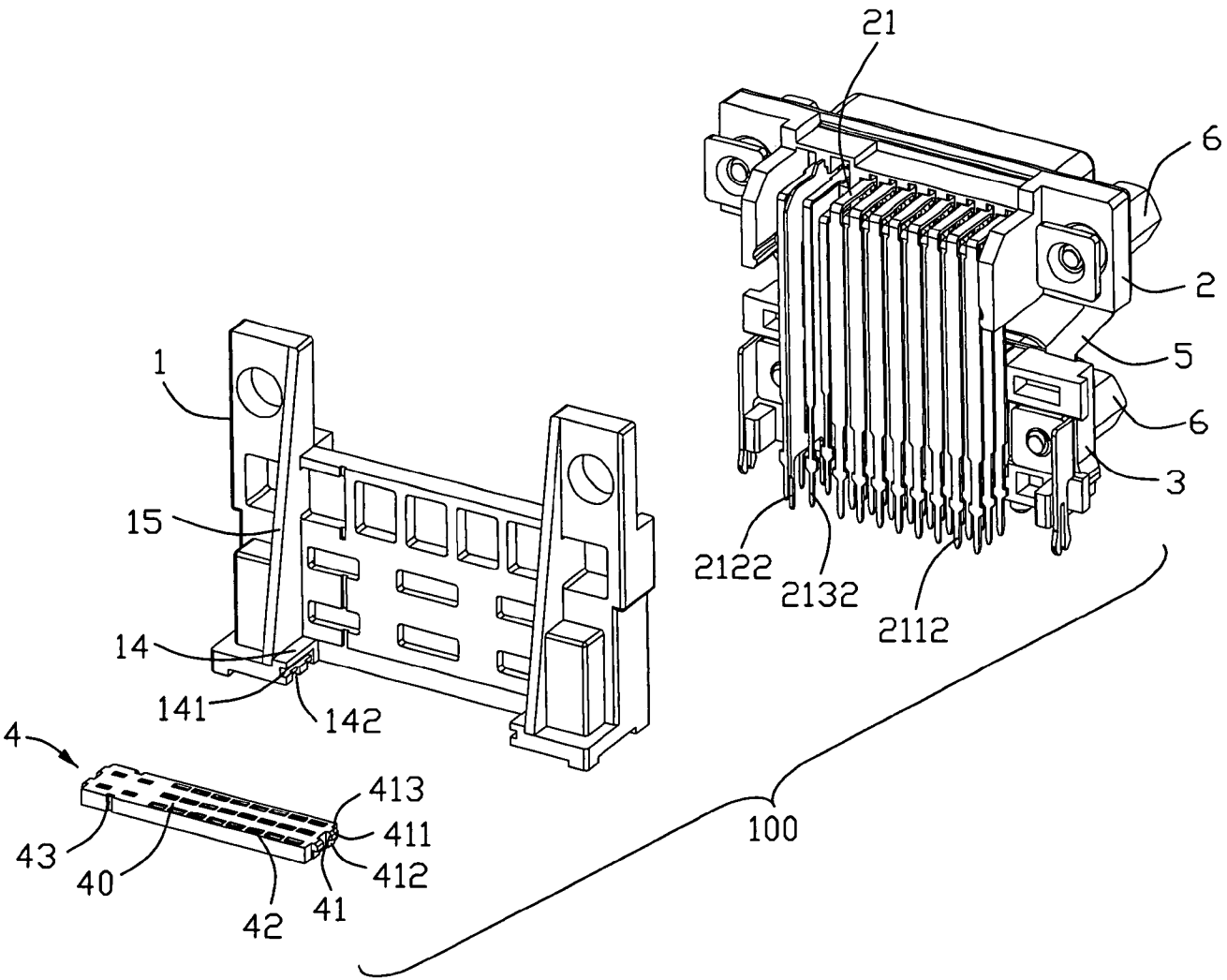
FIG. 3 is an another party exploded perspective view of the electrical connector assembly of FIG. 1.

Referring to FIG. 3 and FIG. 5, the spacer 4 includes a lever bar 40 with a plurality of through holes 42 corresponding to the soldering tails 2112, 2132 of the first terminals 211, 213 of the first electrical connector 2, and a pair of protrude portion 41 protruding outer from two opposite side of the lever bar 40.

The lever bar 40 defines a plurality of slots 43 corresponding to the soldering tails 2122 of the second terminals 212 of the first electrical connector 2 and positioned at two opposite outer sides therein. The protrude portion 41 includes a long portion 411 with an incline surface 413 positioned on a top end therein and a plurality of short portions 412 located under the long portion 411 and connecting to the long portion 411.

Referring to FIG. 4, the connect plate 5 defines two labs 50 positioned on two opposite sides thereof.

Referring to FIGS. 1-8, The electrical connector assembly 100 is in assembly, firstly, all the parts of the first electrical connector 2 are in assembly. The terminals 21 are inserted into the passages 207 of the first housing 20. The first shell 22 encloses the mating portion 202. The soldering tail 2112, 212122, 2132 of the terminals 21 of the first electrical connector 2 extends downwardly out of the bracket 1. Then, the first electrical connector 2 is retained into the upper receiving space 110. The side bars 203 is supported by a inner side of the partition bar 10. All the retaining holes 111 of the bracket 1, the through holes 206 of the first housing 20 and the circular holes 223 of the first shell 22 are arranged in a line to allow the rivets 23 to pass through and fix with each other. The mating portion 202 protrudes at front of the bracket 1, the nuts 6 are retained at front ends of the rivets 26 for fixing the plug. The spacer 4 is retained on the bottom portion of the bracket 1. The protrude portion 41 of the spacer 4 is latched with the fixing portion 14. The long portion 411 is inserted into the first fixing slot 141 of the fixing portion 14 along the incline surface 413 for preventing the spacer 4 moving in the vertical direction relative to the bracket 1. The short portions 412 are inserted into the second fixing slots 142 in order to prevent the spacer 4 from moving backwardly relative to the bracket 1. The soldering tails 2112, 2132, 2122 are fixed by the through holes 42 and slots 43 of the spacer 4.

Secondly, the second electrical connector 3 are retained into the lower receiving space 142 upwardly. The mating portion 302 protrudes forwardly out of the front surface of the bracket 1. The soldering tails 312 extend downwardly out of the bracket 1. The protrude bars 3012 are inserted inwardly the first slots 121 of the bracket 1 in order to prevent the second electrical connector 3 moving in a front-to-back direction relative to the bracket 1. The ribs 3013 and board locks 34 are inserted into the second slots 122. The mounting portions 340 of the board locks 34 are sandwiched by the ribs 3013 and a inner side of the second slots 122. The mounting legs 342 extend out of the bracket 1 for mounting to the PCB 200. The latch portions 3010 of the second housing 30 latches with the block 123 along the guide surface 124. The second electrical connector 3 is restricted in an upper-to-down direction by the partition bar 10 and the block 123.

Lastly, The connect plats 5 are located in the depression 102 of the partition bar 10. Two ends of the connect plates 5 are inserted into the depressions 208, 308 of the housings 20, 30 to urge the labs 50 contacting to the shells 21, 30. The first shell 20 and the second shell 30 are connected electrically by the connect plates 5. All the shells 20, 30 are to be grounding by the board locks 34 connecting with the PCB 200. Furthermore, the shield 33 is disposed between the terminal 21 of the first electrical connector 2 and the terminals 31 of the second electrical connector 3 in order to reduce electromagnetism disturb therein and for ensuring signal transmission of the electrical connector 2, 3.

The first electrical connector 2 is raised by the bracket 1 for transmitting high frequency digital signal and satisfying many applications of electrical products.

It is to be understood, however, that even though numerous characteristics and advantages of the present invention have been set fourth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical connector assembly comprising:

a bracket including a partition bar and a pair of lower stands extending downwardly from two opposite sides of the partition bar; and a first electrical connector located on the bracket, the first electrical connector including a first housing defining a plurality of passages, a plurality of terminals secured in the first housing and a shell covering the first housing, the first housing positioned above the partition bar;

wherein the bracket further comprises a lower receiving space disposed under the partition bar and between the lower stands, the passages including a plurality of first passages arranged in a number of rows and a second passage different from the first passages; wherein the first passages and the second passage formed on opposite sides of the first housing;

wherein the electrical connector assembly further comprises a second electrical connector received in the lower receiving space, the second electrical connector includes a second housing, a plurality of terminals receiving into the second housing and a shell covering a front end of the second housing, the second housing has a latch portion on at least one side and the lower stands have at least one block on an inner side that latches with the at least one latch portion.

2. The electrical connector assembly as claimed in claim 1, wherein the first housing defines a front mating surface, the first passages are disposed in a matrix configuration, the first passages are square positioned in the mating surface, but the second passage is disposed in a cross configuration in the mating surface; wherein the passages further include a third passage disposed at a side of the second passage.

3. The electrical connector assembly as claimed in claim 2, wherein the terminals includes a plurality of first terminals, a second terminal and a third terminal corresponding to the first passages, the second passage and the third passage, each of the terminals has a contact portion extending into the passages for contacting a plug and a soldering tail extending out of the bracket for connecting to a PCB.

4. The electrical connector assembly as claimed in claim 3, wherein each of the contact portion of the first terminal and the third terminal is formed in an offset manner in both a vertical direction and a left-to-right direction.

5. An electrical connector assembly comprising:

an insulative bracket defining upper and lower levers;

a lower connector disposed at the lower level and defining a lower mating port with a pair of lower locking nuts by two sides of said lower mating port for connecting to a first complementary connector, a lower metallic shell enclosing said lower mating port;

an upper connector disposed at the upper level and defining an upper mating port with a pair of upper locking nuts by two sides of said upper mating port for connecting to a second complementary connector, an upper metallic shell enclosing said upper mating port;

a pair of connect plates linked between the upper connector and the lower connector, each of said connect plate defining upper and lower ends respectively engaged with the upper and lower metallic shells; wherein at least one of said upper connector and said lower connector is assemble to the bracket;

wherein said bracket defines a pair of slots at the lower level to receive a pair of board locks of the lower connector.

6. The electrical connector assembly as claimed in claim 1, wherein the bracket includes a connect wall connecting the pair of the lower stands therebetween, the lower receiving space is formed between by the connect wall and the pair of the stands.

7. The electrical connector assembly as claimed in claim 1, wherein the second electrical connector includes a metal shield enclosing a rear end of the second housing and disposed between the terminals of the first electrical connector and the terminals of the second electrical connector.

8. The electrical connector assembly as claimed in claim 6, wherein the lower stands defines a first slot and a second slot, the second housing has at least one protrude bar extending outwardly and at least one rib extending backwardly, the two ribs are secured in the first slot and the second slot respectively.

9. The electrical connector assembly as claimed in claim 7, wherein the electrical connector assembly comprises a metal connect plate, the connect plate defines two protrude portions contacting the first shell and second shell, the bracket defines a depression for receiving the connect plate.

10. The electrical connector assembly as claimed in claim 7, wherein the shield includes a rear wall and two side walls bent from and extending perpendicularly to the rear wall, the side walls define a fixing portion bent from a front end of the side walls and extending outwardly, the second housing defines two engaging slot to receiving the side walls, the fixing portion presses on a front surface of the second housing.

11. The electrical connector assembly as claimed in claim 1, wherein the bracket comprises a pair of upper stands extending upwardly from two opposite sides of the partition bar, the partition bar and the pair of the upper stands define an upper receiving space to receive the first electrical connector.

12. The electrical connector assembly as claimed in claim 1, wherein the first electrical connector is a DVI electrical connector, and the second electrical connector is a D-Sub electrical connector.

13. An electrical connector assembly comprising:

a bracket including a partition bar, a pair of upper stands extending upwardly from two opposite sides of the partition bar, and a pair of lower stands extending downwardly from two opposite sides of the partition bar, an upper receiving space disposed above the partition bar and between the pair of upper stands, and a lower receiving space disposed below the partition bar and between the pair of lower stands;

a first electrical connector received in the upper receiving space, the first electrical connector including a first housing defining a plurality of passages, a plurality of terminals secured into the first housing and a first shell covering the first housing, the passages including a plurality of first passages arranged in a number of rows and a second passage different from the first passages, the first passages and the second passage formed on opposite sides of the first housing; and a second electrical connector received in the lower receiving space and including a second housing and a plurality of terminals received in the second housing;

wherein the lower stands define a first slot recessed on an inner side wall thereof for receiving the second housing in order to prevent the second electrical connector from moving in a mating direction of a plug, and a block locking with the second housing for preventing the second electrical connector from moving in a vertical direction that is perpendicular to the mating direction.

14. The electrical connector assembly as claimed in claim 5, wherein the bracket defines a pair of through holes in the upper levels to fasten the upper connector thereto via a pair of rivets.

15. The electrical connector assembly as claimed in claim 13, wherein the second housing defines a protrude bar receiving the first slot and a latch portion extending from the protrude bar, the latch portion latching with a top surface of the block.

16. The electrical connector assembly as claimed in claim 13, wherein the second electrical connector includes a second shell covering the second housing, the electrical connector assembly further includes a metal connect plate contacting the first and second shells, the partition bar defines a depression for receiving the connect plate.

17. The electrical connector assembly as claimed in claim 5, where the bracket defines a pair of depressions to compliantly receive said pair connector plates.

* * * * *